US005107242A

United States Patent [19]

Imai et al.

[11] Patent Number: 5,107,242

[45] Date of Patent: Apr. 21, 1992

[54] VOLTAGE NON-LINEAR RESISTOR FOR GAPPED LIGHTNING ARRESTORS AND METHOD OF PRODUCING THE SAME

[75] Inventors: Osamu Imai, Kasugai; Ritsu Sato, Iwakura; Kunio Ohira, Ama, all of Japan

[73] Assignee: NGK Insulators, Ltd., Aichi, Japan

[21] Appl. No.: 657,100

[22] Filed: Feb. 19, 1991

[30] Foreign Application Priority Data

Aug. 20, 1990 [JP] Japan ..... 2-217205

[51] Int. Cl.[5] ..... H01C 7/10

[52] U.S. Cl. ..... 338/21; 29/610.1; 252/521; 361/128

[58] Field of Search ..... 338/20, 21; 29/610.1; 361/117, 126, 127, 128, 129, 130; 252/521, 518, 519

[56] References Cited

U.S. PATENT DOCUMENTS

| | | | |
|---|---|---|---|
| 3,811,103 | 5/1974 | Matsuoka et al. | 338/20 |
| 3,962,144 | 6/1976 | Matsuura et al. | 252/521 X |
| 4,290,041 | 9/1981 | Utsumi et al. | 338/21 |
| 4,386,021 | 5/1983 | Kazuo et al. | 252/519 |
| 4,551,268 | 11/1985 | Eda et al. | 252/519 |
| 5,039,971 | 8/1991 | Imai et al. | 338/21 |

*Primary Examiner*—Marvin M. Lateef
*Attorney, Agent, or Firm*—Parkhurst, Wendel & Rossi

[57] ABSTRACT

An excellent voltage non-linear resistor for use in a gapped lightning arrestor having a composition containing (1) 0.5–1.2 mole % of bismuth oxide calculated as $Bi_2O_3$, (2) 0.3–1.5 mole % of cobalt oxide calculated as $Co_2O_3$, (3) 0.2–0.8 mole % of manganese oxide calculated as $MnO_2$, (4) 0.5–1.5 mole % of antimony oxide calculated as $Sb_2O_3$, (5) 0.1–1.5 mole % of chromium oxide calculated as $Cr_2O_3$, (6) 0.6–2.0 mole % of silicon oxide calculated as $SiO_2$, (7) 0.8–2.5 mole % of nickel oxide calculated as NiO, (8) 0.004–0.04 mole % of aluminum oxide calculated as $Al_2O_3$, 0.0001–0.05 mole % of boron oxide calculated as $B_2O_3$, (10) 0.001–0.05 mole % of silver oxide calculated as $Ag_2O$, and (11) the rest of zinc oxide, (12) a limited current of 250–350 V/mm at a current density of 0.1 A/cm$^2$ calculated per unit thickness of the sintered resistor, (13) a limited current ratio of $V_{0.1A}/V_{0.1mA}$ of 1.2–1.7 at current densities of 0.1 A/cm$^2$ and 0.1 mA/cm$^2$, and (14) a deterioration rate of limited current of not more than 3% at a current density of 0.1 A/cm$^2$ before and after applying twice a lightning surge current (4/10 μs wave form) of 5 KA/cm$^2$ per unit surface area.

2 Claims, 1 Drawing Sheet

VOLTAGE NON-LINEAR RESISTOR FOR GAPPED LIGHTNING ARRESTORS AND METHOD OF PRODUCING THE SAME

BACKGROUND OF THE INVENTION

1. Field of the Invention

The present invention relates to voltage non-linear resistors consisting essentially of zinc oxide, particularly voltage non-linear resistors for use in lightning arrestors having a gap between a limited current element portion and an insulator which will be referred to as "gapped lightning arrestors" in the present invention.

2. Related Art Statement

Heretofore, resistors consisting essentially of zinc oxide (ZnO) and containing a small amount of metal oxide, such as $Bi_2O_3$, $Sb_2O_3$, $SiO_2$, $Co_2O_3$ or $MnO_2$, etc., as a subsidiary component, having been widely known to exhibit superior non-linear voltage-current characteristic properties, so that they are widely used in lightning arrestors, etc.

Meanwhile, more than half of electrical troubles on overhead power supply or distribution lines arranged on towers at high positions from the ground are occupied by troubles caused by lightnings. If an electric potential of the tower is increased due to hit of a lightning on a power supply or distribution line thereof, the increased electric potential is discharged from the tower via an arc horn, and subsequent trouble current (dynamic current) is shut off by a circuit breaker in a transformer station, so that electric power supply through the power supply or distribution line is stopped. In order to solve the problem, gapless lightning arrestors have hitherto been used. However, though the gapless lightning arrestors have a good response property as well as a superior dynamic current shut-off property, they are always supplied by an electric current, so that they have poor reliability and can not be supplied again with an electric power in case of trouble. Therefore, a gapped lightning arrestor, as schematically shown in FIG. 1, has attracted attentions. Explaining conceptionally, the arrestor is an insulator device 2 with an arc horn 1 having a lightning-arresting function which consists of a limited current element portion 3 and a seriesly connected gap 4. The limited current element portion 3 is composed of seriesly connected zinc oxide elements having a voltage non-linear resistance property and accommodated in an electrically insulative material (insulator pipe) or molded within an electrically insulative material (ethylene-propylene rubber). By this arrangement, the gapped lightning arrestor aims to discharge at the seriesly connected gap 4 an elevated tower potential produced by hit of a lightning on the power supply or distribution line and shuts off the dynamic current in a short period of time by using the voltage non-linear resistance property of the limited current element portion 3 thereby to prevent electric power stoppage caused by actuation of the circuit breaker of the transformer station.

However, when using such gapped arrestor, a gapped arrestor has to be newly inserted between the power supply towers, so that a compact arrestor is required, hence shortening of the length of the limited current element portion is necessary. Also, insulative cooperation of the arc horn 1 is required, and when a power supply line is hit by a lightning a large electric current of the lightning has to be flash connected to the seriesly connected gap 4 so as to prevent a flash connection of the lightning current to the arc horn 1. In order to preferentially flash connect a lightning current to the seriesly connected gap 4 when hit by a lightning, a method can be considered of reducing the number of the voltage non-linear resistor element in the limited current element portion 3 so as to facilitate the flow of the lightning current to the seriesly connected gaps 4. However, large decrease in number of the resistor element allows easily a larger current than conventional to flow, so that the cut-off property of follow current becomes bad. Alternatively, a method can be considered of reducing the distance of the seriesly connected gap 4. However, in such case, a possibility occurs that the seriesly connected gap 4 is flash connected by switching surge discharge current generated by switching of the circuit breaker.

SUMMARY OF THE INVENTION

An object of the present invention is to provide a voltage non-linear resistor having superior cut-off property of follow current, limit voltage at large current area, lightning surge discharge current withstanding capability, switching surge discharge current withstanding capability and electric life and which can shorten the length of the limited current element portion of the gapped lightning arrestor.

Another object of the present invention is to provide a voltage non-linear resistor having a superior insulation cooperative property with the arc horn.

The above objects can now be achieved by the present invention.

The present invention is a voltage non-linear resistor for use in a gapped lightning arrestor having a composition containing (1) 0.5–1.2 mole % of bismuth oxide calculated as $Bi_2O_3$, (2) 0.3–1.5 mole % of cobalt oxide calculated as $Co_2O_3$, (3) 0.2–0.8 mole % of manganese oxide calculated as $MnO_2$, (4) 0.5–1.5 mole % of antimony oxide calculated as $Sb_2O_3$, (5) 0.1–1.5 mole % of chromium oxide calculated as $Cr_2O_3$, (6) 0.6–2.0 mole % of silicon oxide calculated as $SiO_2$, (7) 0.8–2.5 mole % of nickel oxide calculated as NiO, (8) 0.004–0.04 mole % of aluminum oxide calculated as $Al_2O_3$, (9) 0.0001–0.05 mole % of boron oxide calculated as $B_2O_3$, (10) 0.001–0.05 mole % of silver oxide calculated as $Ag_2O$, and (11) the rest of zinc oxide, (12) a limited current of 250–350 V/mm at a current density of 0.1 A/cm² calculated per unit thickness of the sintered resistor, (13) a limited current ratio $V_{0.1A}/V_{0.1mA}$ of 1.2–1.7 at current densities of 0.1 A/cm² and 0.1 mA/cm², and (14) a deterioration rate of limited current of not more than 3% at a current density of 0.1 A/cm² before and after applying twice a lightning surge current (4/10 μs wave form) of 5 KA/cm² per unit surface area.

The present invention is also a method of producing a voltage non-linear resistor for use in a gapped lightning arrestor, comprising i) forming a green body of the voltage non-linear resistor having a composition containing (1) 0.5–1.2 mole % of bismuth oxide calculated as $Bi_2O_3$, (2) 0.3–1.5 mole % of cobalt oxide calculated as $Co_2O_3$, (3) 0.2–0.8 mole % of manganese oxide calculated as $MnO_2$, (4) 0.5–1.5 mole % of antimony oxide calculated as $Sb_2O_3$, (5) 0.1–1.5 mole % of chromium oxide calculated as $Cr_2O_3$, (6) 0.6–2.0 mole % of silicon oxide calculated as $SiO_2$, (7) 0.8–2.5 mole % of nickel oxide calculated as NiO, (8) 0.004–0.04 mole % of aluminum oxide calculated as $Al_2O_3$, (9) 0.0001–0.05 mole % of boron oxide calculated as $B_2O_3$ (10) 0.001–0.05 mole % of silver oxide calculated as $Ag_2O$, and (11) the rest of zinc oxide, ii) the green body being formed by mixing zinc oxide of (11) and a solution containing aluminum of an amount corresponding to aluminum oxide of (8), spray drying the mixture, calcining the spray dried mixture, granulating the calcined mixture and the other said metal oxides added thereto, and shaping, iii) firing at 1,130°–1,240° C., and iv) heat treating at 530°–900° C.

For realizing the shortening of the length of the limited current element portion, the inventors used the following two ways.

The first way is to increase the maximum current which flows through the element of the limited current element portion when a rated voltage is applied thereon to 0.1 A from 0.1 mA per unit surface area ($cm^2$) of the element. Though the maximum current of 0.1 mA has been adopted in designing conventional lightning arrestors, the maximum current is increased to 0.1 A in the present invention so that the decrease in number of the element of the limited current element portion can be realized. A further increase of the maximum current above 0.1 A is impossible, because such increase of the maximum current worsens the cut-off property of follow current of the resistor element.

When the maximum current is increased to 0.1 A from 0.1 mA, sufficient attention should be paid to prevent deterioration of the limited voltage after application of a lightning surge current. This is because deterioration of the limited voltage incurs adverse effects over the dynamic current shut-off property and the electrical life of the resistor element, and such adverse effects are influenced more largely by deterioration of the limited current $V_{0.1\,A}/cm^2$ (hereinafter, abbreviated as $V_{0.1\,A}$) at the current density of 0.1 $A/cm^2$ than by deterioration of the limited current $V_{0.1}$ $mA/cm^2$ (hereinafter abbreviated as $V_{0.1\,mA}$) at the current density of 0.1 $mA/cm^2$, as clearly seen from the voltage-current characteristic property of the resistor element of FIG. 2. Therefore, though about 10% of deterioration of the limited voltage caused by application of a lightning surge current has been permissible in conventional resistor element, deterioration of the limited voltage caused by the application of a lightning surge current has to be suppressed to not over than 3% in the present invention, otherwise the resistor element of the present invention can not be used in practice.

The lightning surge current which incurs the deterioration of the limited voltage is evaluated by deterioration of the characteristic property after twice applying a lightning surge current of a current density of 5 $KA/cm^2$ (4/10 μs wave form). This is because lightning arrestors are generally designed to twice apply the above current.

Next, the second way is to raise the limited voltage $V_{0.1\,A}$ of the element in the limited current element portion. The decrease in number of the element in the limited current portion can be realized also by raising the limited voltage $V_{0.1\,A}$. However, if the limited voltage $V_{0.1\,A}$ exceeds 350 V/mm, the lightning surge discharge current withstanding capability of the resistor element is deteriorated and the electric life is shortened. Usually, the gapped lightning arrestor insulators are not always applied by electric current at the limited current element portion, so that their electric life is usually out of consideration. However, the electric life has to be considered in the present invention, because the seriesly connected gap 4 is occasionally clogged by bird droppings to pass an electric current therethrough.

BRIEF DESCRIPTION OF THE DRAWINGS

For a better understanding of the present invention, reference is made to the accompanying drawings, in which.

Numberings in the Drawings.

Figure 1:
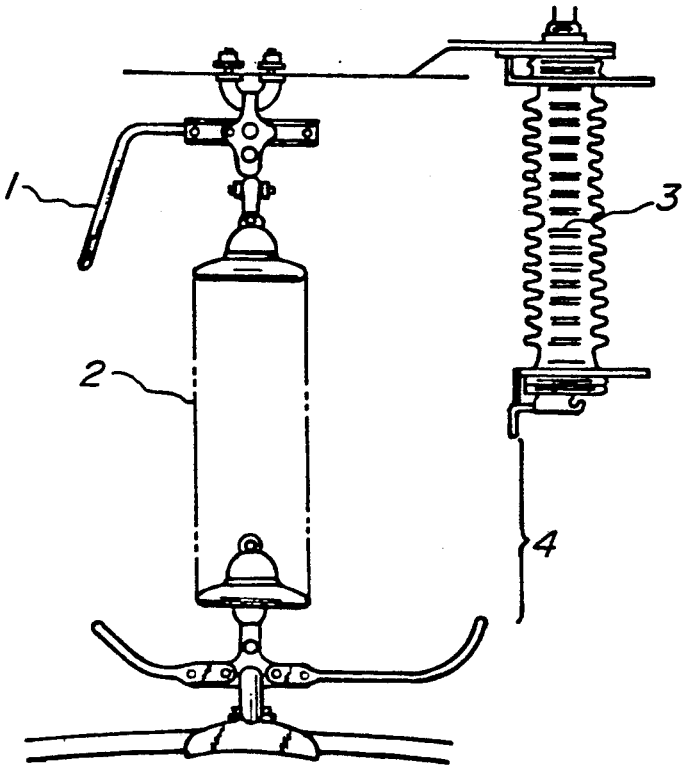
FIG. 1 is a schematic explanational diagram of a gapped lightning arrestor having an arc horn for use in an electric power supply tower.

1 . . . arc horn
2 . . . insulator device
3 . . . limited current element portion
4 . . . seriesly connected gap

DESCRIPTIVE EXPLANATION OF THE DRAWINGS

Hereinafter, the present invention will be explained in more detail.

Bismuth oxide is used in an amount of 0.5–1.2 mole %, preferably 0.6–0.9 mole %, calculated as $Bi_2O_3$. $Bi_2O_3$ forms a grain boundary layer in ZnO grains and is an important adding agent which is considered to participate in forming a Schottky barrier relating to exhibition of the voltage non-linear resistor's characteristic property.

If the amount of $Bi_2O_3$ is less than 0.5 mole %, the lightning surge discharge current withstanding capability is deteriorated. While if it exceeds 1.2 mole %, the rate of deterioration (hereinafter, abbreviated as $\Delta V_{0.1\,A}$) of the limited voltage ($V_{0.1\,A}/cm^2$) after application of a lightning surge is increased.

Cobalt oxide and manganese oxide are used, calculated as $Co_2O_3$ and $MnO_2$, in an amount of 0.3–1.5 mole %, preferably 0.5–1.2 mole %, for $Co_2O_3$, and 0.2–0.8 mole %, preferably 0.3–0.7 mole %, for $MnO_2$. $Co_2O_3$ and $MnO_2$ are portionally solid soluted in ZnO grains, while portionally precipitated in the grain boundary layer to raise the level of the Schottky barrier of the resistor. Also, they are considered to participate in stabilizing the Schottky barrier. If the amount of $Co_2O_3$ is less than 0.3 mole %, $\Delta V_{0.1\,A}$ after application of a lightning surge is increased, while if it exceeds 1.5 mole %, $\Delta V_{0.1\,A}$ also after application of a lightning surge is also increased. If the amount of $MnO_2$ is less than 0.2 mole %, the electric life of the resistor is shortened, while if it exceeds 0.8 mole %, the electric life is also shortened.

Antimony oxide and chromium oxide are used, calculated as $Sb_2O_3$ and $Cr_2O_3$, in an amount of 0.5–1.5 mole %, preferably 0.8–1.2 mole %, for $Sb_2O_3$ and 0.1–1.5 mole %, preferably 0.3–1.0 mole %, for $Cr_2O_3$. $Sb_2O_3$ and $Cr_2O_3$ react with ZnO to form spinel phases whereby development of extraordinary grains of ZnO grains is prevented, so that homogeneity of the sintered body is improved.

If the amount of $Sb_2O_3$ is less than 0.5 mole %, $\Delta V_{0.1\,A}$ after application of a lightning surge is deteriorated, while if it exceeds 1.5 mole %, $\Delta V_{0.1A}$ also after application of a lightning surge is also deteriorated, and the switching surge discharge current withstanding capability and the lightning surge discharge current withstanding capability become bad. If the amount of $Cr_2O_3$ is less than 0.1 mole %, $\Delta V_{0.1A}$ after application of a lightning surge is deteriorated, while if it exceeds 1.5 mole %, $\Delta V_{0.1A}$ also after application of a lightning surge is also deteriorated.

Silicon oxide is used in an amount of 0.6–2.0 mole %, preferably 0.7–1.4 mole %, calculated as $SiO_2$. $SiO_2$ precipitates in the grain boundary layer to prevent development of ZnO grains. If amorphous silica is used, it has advantageous effects of achieving an improved reactivity and hence improving the characteristic property of the resistor. If the amount of $SiO_2$ is less than 0.6 mole %, the lightning surge discharged current withstanding capability is deteriorated, while if it exceeds 2.0 mole %, the lightning surge discharge current withstanding capability is deteriorated, and $\Delta V_{0.1A}$ after application of a lightning surge is deteriorated.

Nickel oxide is used in an amount of 0.8–2.5 mole %, preferably 1.0–1.5 mole %, calculated as NiO. The addition of NiO is effective in improving $\Delta V_{0.1\,A}$ after application of a lightning surge as well as a limited voltage ratio $V_{5KA}/cm^2/V_{0.1\,A}/cm^2$ (hereinafter, abbreviated as $V_{5KA}/V_{0.1\,A}$) at large current area. If the amount of NiO is less than 0.8 mole %, $\Delta V_{0.1\,A}$ after application of a lightning surge and the limited voltage ratio $V_{5KA}/V_{0.1A}$ at large current area are not improved, while if it exceeds 1.5 mole %, $\Delta V_{0.1\,A}$ after application of a lightning surge is conversely deteriorated, and the switching surge discharge current withstanding capability is deteriorated.

Aluminum oxide is used in an amount of 0.004–0.04 mole %, preferably 0.006–0.02 mole %, calculated as $Al_2O_3$. $Al_2O_3$ has a function of solid soluting in ZnO to decrease the resistance of ZnO grains thereby to improve the limited voltage ratio $V_{5KA}/V_{0.1\,A}$ at large current area. It has also functions of decreasing V-I characteristic property (particularly $V_{0.1\,A}/V_{0.1\,mA}$) at minute current area and improving the dielectric constant. However, if the amount of addition of $Al_2O_3$ is increased, $\Delta V_{0.1\,A}$ after application of a lightning surge is decreased. If the amount of $Al_2O_3$ is less than 0.004 mole %, the limited voltage ratio $V_{0.1\,A}/V_{0.1\,mA}$ becomes less than 1.2 and the function of improving the limited voltage ratio at large current area can not be exhibited. If the amount of $Al_2O_3$ exceeds 0.04 mole %, when the limited voltage ratio $V_{0.1A}/V_{0.1mA}$ exceeds 1.7, the limited voltage ratio $V_{5KA}/V_{0.1A}$ at large current area assumes a flat curve reaching a maximum value, and the lightning surge discharge current withstanding capability and $\Delta V_{0.1A}$ after application of a lightning surge are deteriorated.

Boron oxide and silver oxide are used, calculated as $B_2O_3$ and $Ag_2O$, in an amount of 0.0001–0.05 mole %, preferably 0.001–0.03 mole %, for $B_2O_3$ and 0.001–0.05 mole %, preferably 0.002–0.03 mole %, for $Ag_2O$. Both the $B_2O_3$ and $Ag_2O$ have a function of stabilizing the grain boundary layer. (Preferably, they are added in a form of a bismuth borosilicate glass containing Ag so that the electric life can be improved. The glass may contain other metal oxides, such as ZnO, etc.) If the amount of $B_2O_3$ is less than 0.0001 mole %, the function of $B_2O_3$ of improving the electric life can not be exhibited well, while if it exceeds 0.05 mole %, $\Delta V_{0.1A}$ after application of a lightning surge is deteriorated. If the amount of $Ag_2O$ is less than 0.001 mole %, the function of $Ag_2O$ of improving $\Delta V_{0.1\,A}$ is small, while if it exceeds 0.05 mole %, $\Delta V_{0.1\,A}$ is conversely deteriorated.

The reason why the limited voltage $V_{0.1\,A}$ at a current density of 0.1 A/cm² is defined to 250–350 V/mm (preferably 260–310 V/mm) is because if it is less than 250 V/mm, the aimed minimization of the limited current element portion can not be achieved and $\Delta V_{0.1\,A}$ after application of a lightning surge becomes bad, while if it exceeds 350 V/mm, the lightning surge discharge current withstanding capability is deteriorated, as described above. For that reason, the green resistor body of the aforementioned composition is fired at 1,130°–1,240° C.

The reason why the deterioration rate of limited voltage $\Delta V_{0.1\,A}$ (after twice applying a current of a wave form of 4/10 μs of a current density of 5 KA/cm²) is defined to not more than 3% (preferably not more than 1%) is because if $\Delta V_{0.1\,A}$ exceeds 3%, the cut-off property of follow current and the electric life of the resistor are deteriorated, and hence a designing of lightning arrestors under an assumption that a maximum current which flows through the resistor element when applying a rated voltage is 0.1 A/cm² (hereinafter, abbreviated as "designing of $V_{0.1\,A}$") becomes impossible.

In order that the deterioration rate of limited voltage $\Delta V_{0.1\,A}$ is not more than 3%, the green resistor body of the aforementioned composition is (1) heat treated at 530°–900° C. for preferably at least 2 hrs (more preferably at least 5 hrs), the amount of $Al_2O_3$ in the composition being not more than 0.04 mole %, (2) calcination of Al and ZnO is effected at 500°–1,000° C., preferably 600°–900° C.

In order that the deterioration rate of limited voltage $\Delta V_{0.1\,A}$ is not more than 1%, the green resistor body of the aforementioned composition is (1) heat treated at 550°–850° C. for preferably at least 2 hrs (more preferably at least 5 hrs), the amount of $Al_2O_3$ in the composition being not more than 0.02 mole %, (2) calcination of Al and ZnO is effected at 500°–1,000° C., preferably 600°–900° C., and (3) the calcined product of Al and ZnO and the other metal oxides are finely milled and mixed in an atlighter. By mixing in the atlighter, ZnO containing solid soluted Al and the remaining metal oxides are uniformly mixed and dispersed, so that homogeneity of the register element is improved to achieve good electric properties. Particularly, the deterioration of the limited voltage after application of a lightning surge is improved.

The reason of defining the limited voltage ratio $V_{0.1\,A}/V_{0.1\,mA}$ to 1.2–1.7 (preferably, 1.3–1.5) is because if $V_{0.1\,A}/V_{0.1\,mA}$ is less than 1.2, an electric current can hardly flow at minute current area, so that an excessively large lightning surge current when hit by a lightning can not assuredly be flash connected at the seriesly connected gap of the gapped lightning arrestor, and hence the insulation cooperative property with the arc horn becomes bad. While if it exceeds 1.7, though the insulation cooperative property with the arc horn is good, an excessively large current is flowed in case when the seriesly connected gap of the gapped lightning arrestor is electrically connected for a long time due to bird droppings or the like, so that thermal deregulation of the register element occurs to break down the register element.

In order that the limited voltage ratio $V_{0.1\,A}/V_{0.1\,mA}$ is 1.2–1.7, the green resistor body of the aforementioned composition is (1) heat treated at 530°–900° C. for preferably at least 2 hrs (more preferably at least 5 hrs), the amount of $Al_2O_3$ in the composition being in a range of 0.004–0.04 mole %, and the above treatment (2) is effected similarly as described above.

In order that the limited voltage ratio $V_{0.1\,A}/V_{0.1\,mA}$ is 1.3-1.5, the green resistor body of the aforementioned composition is (1) heat treated at 550°-850° C. for preferably at least 2 hrs (more preferably at least 5 hrs), the amount of $Al_2O_3$ in the composition being in a range of 0.006-0.02 mole %, and the above treatment (2) is effected similarly as described above.

Usually, a heat treatment at 550°-700° C. is more preferable, because the switching surge discharge current withstanding capability is improved.

The limited voltage ratio at current densities of 10 A/cm$^2$ and 0.1 A/cm$^2$ is preferably 1.15-1.35, more preferably 1.2-1.3. Adopting the ratio in this range, the cut-off property of follow current is further improved as well as the switching surge discharge current withstanding capability. For adopting the ratio in the range, the amount of $B_2O_3$ in the aforementioned composition should be in a range of 0.001-0.01 mole % and the amount of $Ag_2O$ should be in a range of 0.006-0.02 mole %.

The limited voltage ratio $V_{5KA}/V_{0.1\,A}$ at large current area is preferably not more than 2.3, particularly not more than 2.2. Adopting the ratio in this range, the length of the limited current element portion can further be shortened and the lightning surge discharge current withstanding capability can also be improved. For adopting the ratio in the range, the amount of $Al_2O_3$ in the aforementioned composition is preferably not less than 0.005 mole %, particularly not less than 0.007 mole %.

In order to obtain the voltage non-linear resistor body of the present invention, calcination of Al and ZnO is effected at first. Namely, a solution preliminarily containing a desired amount of aluminum is mixed with zinc oxide, spray dried, calcined, and the calcined product is mixed with the other metal oxides of the composition and treated in the same manner as described, whereby the limited voltage ratio $V_{0.1\,A}/V_{0.1\,mA}$ and $\Delta V_{0.1\,A}$ after application of a lightning surge can be controlled, and the lightning surge discharge current withstanding capability can be improved as well as the electric life and the limited voltage ratio at large current area.

In such instance, the following functions and effects can be obtained.

(1) Because a solution state of aluminum is mixed with zinc oxide, aluminum is solid soluted in zinc oxide in a size of atomic level, so that homogeneity of the register body can be improved and the resistance of zinc oxide grains is largely decreased. The solution of aluminum is preferably an aqueous solution, etc., of nitrate chloride, for example. Content of the solid in the mixed solution is preferably in a range of 50-75 wt %.

(2) Because the mixed solution or slurry is spray dried to remove water at once, a dried product can be obtained having a uniform distribution of aluminum concentration, so that the homogeneity of the register body can be improved. In this case, a slow drying of the mixture in a bat or the like container is not preferable, because portional difference of concentration of zinc oxide in the aluminum solution occurs. Temperature of the spray drying is preferably 200°-500° C.

(3) By calcining the dried powder, aluminum is uniformly and sufficiently solid soluted in the grains of zinc oxide. In conventional methods, solid soluting of aluminum into zinc oxide is effected by firing a mixture of aluminum, zinc oxide and the other metal oxides, so that aluminum is not sufficiently solid soluted in zinc oxide and remains in the grain boundary layer and hence gives adverse influences on the electric life, the lightning surge discharge current withstanding capability and the limited voltage after applying a lightning surge.

The calcination is preferably effected at a temperature of 500°-1,000° C., more preferably 600°-900° C. If the temperature is less than 500° C., the solid soluting of aluminum into zinc oxide is not effected sufficiently, while if it exceeds 1,000° C., the sintering of zinc oxide proceeds rapidly.

More concretely explaining, at first a solution containing a desired amount of aluminum, e.g., an aqueous solution of aluminum nitrate, etc., a zinc oxide raw material having a grain size of about 0.5 μm, and a desired dispersant, etc., are mixed, and the resultant mixture is spray dried by a spray dryer for example to obtain a dried powder. The thus obtained powder is calcined at a temperature of 500°-1,000° C. preferably in an oxidizing atmosphere to obtain a zinc oxide raw material having a desired grain size of preferably not more than 3 μm, more preferably not more than 1 μm. The zinc oxide raw material is preferably milled. Then, the zinc oxide raw material is mixed with a desired amount of adding agent (the other metal oxides) consisting of bismuth oxide, cobalt oxide, manganese oxide, antimony oxide, chromium oxide, silicon oxide, nickel oxide, silver oxide, and boron oxide, etc., prepared to desired grain sizes. In this case, silver nitrate and boric acid may be used instead of silver oxide and boron oxide. Preferably, a bismuth borosilicate glass containing silver is used instead of silver oxide and boron oxide. The mixture powder of these raw materials is added with a desired amount of binder (preferably an aqueous solution of polyvinyl-alcohol) and a dispersant, etc., mixed in a disper mill, preferably in an atlighter, to form a slurry, and granulated by a granulator, preferably by a spray dryer, to obtain granules. Thereafter, the granules are formed to a desired shape under a pressure of 800-1,000 kg/cm$^2$. The formed body is calcined with a heating or cooling rate of 30°-70° C./hr at 800°-1,000° C. for a holding time of 1-5 hrs to obtain a calcined body.

The mixing in the atlighter is preferably effected using zirconia balls as a mixing medium, stabilized zirconia as an agitator arm, and an organic resin (preferably nylon resin) as a lining of the tank so as to minimize the contamination of the mixture caused by the atlighter device. From the viewpoints of uniform mixing and mixing efficiency, the mixing is preferably controlled so as not the temperature of the slurry exceed 40° C. to prevent gelation of the slurry thereby to facilitate the dispersion and mixing of zinc oxide and the other metal oxides. The time for the mixing is preferably 1-10 hrs, more preferably 2-5 hrs. The mixing medium zirconia balls may consists of zirconia stabilized by magnesium oxide (MgO) or calcium oxide (CaO), etc., however, zirconia stabilized by yttrium oxide ($Y_2O_3$) is preferably used for the mixing medium.

Before the calcination, the formed body is preferably heated with a heating or cooling rate of 10°-100° C./hr at 400°-600° C. for 1-10 hrs to dissipate and remove the binder to obtain a degreased body. In the present invention, "green body" means the formed body, the degreased body, or the calcined body.

Next, a highly resistive side layer is formed on a side of the calcined body. For that purpose, a desired amount of bismuth oxide, antimony oxide, silicon oxide, and zinc oxide, etc., is added with an organic binder, such as, ethyl cellulose, butyl carbitol, n-butyl acetate, etc., to prepare a mixture paste for the highly resistive side layer. The paste is applied on the side of the calcined body to a thickness of 60–300 μm. Alternatively, the paste may be applied on the formed body or the degreased body. Then, the calcined body with the applied paste is fired with a heating or cooling rate of 20°–100° C./hr (preferably 30°–60° C./hr) to 1,130°–1,240° C. and held thereat for 3–7 hrs.

Then, the fired body is heat treated with a heating or cooling rate of not more than 200° C./hr at 530°–900° C. (preferably 550°–850° C.) for preferably at least 2 hrs (more preferably at least 5 hrs).

In one aspect, a glass layer may simultaneously be formed on the highly resistive side layer by a heat treatment of applying a glass paste consisting of a glass powder and an organic binder, such as, ethyl cellulose, butyl carbitol, or n-butyl acetate, etc., on the highly resistive side layer to a thickness of 100–300 μm, and heat treating it in air with a heating or cooling rate of not more than 200° C./hr at 530°–900° C. for a holding time of at least 2 hrs.

Thereafter, both end surfaces of the thus obtained voltage non-linear resistor body are polished by a polisher, such as, diamond, etc., of a mesh corresponding to #400–#2,000 using water or oil. Then, the polished end surfaces are rinsed to remove the polisher and the like, and provided with electrodes made of, e.g., aluminum, by means of, for example, thermal melt spray to obtain a voltage non-linear resistor body.

A material other than the aforementioned composition according to the present invention can of course be added to the composition depending on aimed use and purpose of the voltage non-linear resistor, if such material does not largely damage the effects of the resistor.

DESCRIPTION OF THE PREFERRED EMBODIMENTS

Hereinafter, the present invention will be explained in more detail with reference to examples.

EXAMPLES 1–61 AND COMPARATIVE EXAMPLES 1–34

Green bodies of compositions as shown in the later-described Table 1 are treated in the production conditions as shown in Table 1 to produce voltage non-linear register bodies of a size of ϕ47 mm×h22.5 mm of Examples 1–61 and Comparative Examples 1–34. Characteristic properties of these resistors are shown in Table 1.

In the compositions of the voltage non-linear resistor bodies shown in Table 1, amorphous silica is used and $B_2O_3$ and $Ag_2O$ are used after vitrified.

The calcination of Al and ZnO is effected by using and mixing an aqueous solution of aluminum nitrate and zinc oxide, spray drying the mixture at 300° C., and calcining the spray dried mixture at 700° C. The calcined products are pulverized in a pot mill, etc., to an average particle diameter of not more than 1 μm.

The mixing of ZnO and the other metal oxides is effected mainly in an atlighter for 3 hrs using zirconia balls stabilized by yttrium oxide. When the atlighter is not used, a disper mill is used for the mixing for 3 hrs.

The firing is effected at temperatures as shown in Table 1 for a holding time of 5 hrs.

The heat treatment is effected at temperatures as shown in Table 1 for a holding time of 5 hrs with exception of a holding time of 2 hrs for Examples 5, 14, 24 and 38.

As for electric characteristic properties, a limited voltage (expressed by $V_{0.1\,A}$, unit is V/mm), a limited voltage ratio (expressed by $V_{0.1\,A}/V_{0.1\,mA}$), a deterioration rate of limited voltage before and after applying twice (at an interval of 5 min) a lightning surge current (4/10 μs wave form) of 5 KA/cm$^2$ (expressed by $\Delta V_{0.1\,A}$, unit is %), a lightning surge discharge current withstanding capability, and an electric life, are evaluated.

The lightning surge discharge current withstanding capability is a withstanding capability against twice applying a surge current of an electric wave form of 4/10 μs, and expressed by an energy value (calculated by current×voltage×applied time, cleared value, unit is kilo Joule (KJ)). If the lightning surge discharge current withstanding capability is evaluated by a value of current, a right evaluation thereof is impossible, because a voltage to be applied on the resistor element becomes higher with the increase of $V_{0.1\,A}$ of the resistor element and hence the current value of withstanding a lightning surge discharge current becomes a low value.

The electric life is calculated by Arrhenius plot. Resistor elements having an electric life of at least one year at a current applying rate of 85% at 40° C. are expressed by a symbol ○, and those having an electric life of at least 10 years at a current applying rate of 85% at 40° C. are expressed by a symbol ◎.

The present invention is not influenced by a size of the voltage non-linear resistor bodies, and same results were obtained when the resistor bodies have a disc shape of a diameter of 70 mm.

TABLE 1

| | Items | | | | | | | | | | | |
|---|---|---|---|---|---|---|---|---|---|---|---|---|
| | | | | | | | | | | | Production condition | |
| | Composition of green body (mole %) | | | | | | | | | | Calcination of Al and ZnO | Mixing by atlighter |
| Example | $Bi_2O_3$ | $Co_2O_3$ | $MnO_2$ | $Sb_2O_3$ | $Cr_2O_3$ | NiO | $SiO_2$ | $Al_2O_3$ | $B_2O_3$ | $Ag_2O$ | | |
| 1 | 0.5 | 1.0 | 0.5 | 1.0 | 0.5 | 1.3 | 1.0 | 0.01 | 0.005 | 0.01 | yes | yes |
| 2 | 0.6 | " | " | " | " | " | " | " | " | " | " | " |
| 3 | 0.7 | " | " | " | " | " | " | " | " | " | " | " |
| 4 | 0.9 | " | " | " | " | " | " | " | " | " | " | " |
| 5 | 1.2 | " | " | " | " | " | " | " | " | " | " | " |
| 6 | 0.7 | 0.3 | " | " | " | " | " | " | " | " | " | " |
| 7 | " | 0.5 | " | " | " | " | " | " | " | " | " | " |
| 8 | " | 1.2 | " | " | " | " | " | " | " | " | " | " |
| 9 | " | 1.5 | " | " | " | " | " | " | " | " | " | " |
| 10 | " | 1.0 | 0.2 | " | " | " | " | " | " | " | " | " |
| 11 | " | " | 0.3 | " | " | " | " | " | " | " | " | no |
| 12 | " | " | 0.7 | " | " | " | " | " | " | " | " | yes |
| 13 | " | " | 0.8 | " | " | " | " | " | " | " | " | " |
| 14 | " | " | 0.5 | 0.5 | " | " | " | " | " | " | " | " |

TABLE 1-continued

| | | | | | | | | | | | | |
|---|---|---|---|---|---|---|---|---|---|---|---|---|
| 15 | " | " | " | 0.8 | " | " | " | " | " | " | " | " |
| 16 | " | " | " | 1.2 | " | " | " | " | " | " | " | " |
| 17 | " | " | " | 1.5 | " | " | " | " | " | " | " | " |
| 18 | " | " | " | 1.0 | 0.1 | " | " | " | " | " | " | " |
| 19 | " | " | " | " | 0.3 | " | " | " | " | " | " | " |
| 20 | " | " | " | " | 1.0 | " | " | " | " | " | " | no |
| 21 | 0.7 | 1.0 | 0.5 | 1.0 | 1.5 | 1.3 | 1.0 | 0.01 | 0.005 | 0.01 | yes | yes |
| 22 | " | " | " | " | 0.5 | 0.8 | " | " | " | " | " | " |
| 23 | " | " | " | " | " | 1.0 | " | " | " | " | " | " |
| 24 | " | " | " | " | " | 1.5 | " | " | " | " | " | " |
| 25 | " | " | " | " | " | 2.5 | " | " | " | " | " | " |
| 26 | " | " | " | " | 0.5 | 1.3 | 0.6 | " | " | " | " | " |
| 27 | " | " | " | " | " | " | 0.7 | " | " | " | " | no |
| 28 | " | " | " | " | " | " | 1.4 | " | " | " | " | yes |
| 29 | " | " | " | " | " | " | 2.0 | " | " | " | " | " |
| 30 | " | " | " | " | " | " | 1.0 | " | 0.0001 | " | " | " |
| 31 | " | " | " | " | " | " | " | " | 0.001 | " | " | " |
| 32 | " | " | " | " | " | " | " | " | 0.03 | " | " | " |
| 33 | " | " | " | " | " | " | " | " | 0.05 | " | " | " |
| 34 | " | " | " | " | " | " | " | " | 0.005 | 0.001 | " | " |
| 35 | " | " | " | " | " | " | " | " | " | 0.002 | " | " |
| 36 | " | " | " | " | " | " | " | " | " | 0.03 | " | " |
| 37 | " | " | " | " | " | " | " | " | " | 0.05 | " | " |
| 38 | " | " | " | " | " | " | " | " | " | " | " | " |
| 39 | " | " | " | " | " | " | " | 0.004 | 0.05 | 0.01 | " | " |
| 40 | " | " | " | " | " | " | " | " | " | " | " | " |
| 41 | 0.7 | 1.0 | 0.5 | 1.0 | 0.5 | 1.3 | 1.0 | 0.04 | 0.05 | 0.01 | yes | yes |
| 42 | " | " | " | " | " | " | " | " | " | " | " | no |
| 43 | " | " | " | " | " | " | " | " | " | " | " | yes |
| 44 | " | " | " | " | " | " | " | 0.006 | " | " | " | " |
| 45 | " | " | " | " | " | " | " | " | " | " | " | " |
| 46 | " | " | " | " | " | " | " | " | " | " | " | no |
| 47 | " | " | " | " | " | " | " | " | " | " | " | yes |
| 48 | " | " | " | " | " | " | " | " | " | " | " | " |
| 49 | " | " | " | " | " | " | " | 0.01 | " | " | " | " |
| 50 | " | " | " | " | " | " | " | " | " | " | " | " |
| 51 | " | " | " | " | " | " | " | 1.0 | 0.005 | " | " | " |
| 52 | " | " | " | " | " | " | " | 0.02 | " | " | " | " |
| 53 | " | " | " | " | " | " | " | " | " | " | " | " |
| 54 | " | " | " | " | " | " | " | " | " | " | " | no |
| 55 | " | " | " | " | " | " | " | " | " | " | " | yes |
| 56 | " | " | " | " | " | " | " | " | " | " | " | " |
| 57 | " | " | " | " | " | " | " | 0.04 | " | " | " | " |
| 58 | " | " | " | " | " | " | " | " | " | " | " | " |
| 59 | " | " | " | " | " | " | " | " | " | " | " | " |
| 60 | " | " | " | " | " | " | " | " | " | " | " | " |
| 61 | " | " | " | " | " | " | " | " | " | " | " | " |

| Comparative Example | Items: Composition of green body (mole %) | | | | | | | | | | Production condition | |
|---|---|---|---|---|---|---|---|---|---|---|---|---|
| | $Bi_2O_3$ | $Co_2O_3$ | $MnO_2$ | $Sb_2O_3$ | $Cr_2O_3$ | NiO | $SiO_2$ | $Al_2O_3$ | $B_2O_3$ | $Ag_2O$ | Calcination of Al and ZnO | Mixing by atlighter |
| 1 | 0.3 | 1.0 | 0.5 | 1.0 | 0.5 | 1.3 | 1.0 | 0.01 | 0.005 | 0.01 | yes | yes |
| 2 | 1.5 | " | " | " | " | " | " | " | " | " | " | " |
| 3 | 0.7 | 0.1 | " | " | " | " | " | " | " | " | " | " |
| 4 | " | 2.0 | " | " | " | " | " | " | " | " | " | " |
| 5 | " | 1.0 | 0.1 | " | " | " | " | " | " | " | " | " |
| 6 | " | " | 1.0 | " | " | " | " | " | " | " | " | |
| 7 | " | " | 0.5 | 0.2 | " | " | " | " | " | " | " | " |
| 8 | " | " | " | 2.0 | " | " | " | " | " | " | " | " |
| 9 | " | " | " | 1.0 | 0 | " | " | " | " | " | " | " |
| 10 | " | " | " | " | 2.0 | " | " | " | " | " | " | " |
| 11 | " | " | " | " | 0.5 | 0.5 | " | " | " | " | " | " |
| 12 | " | " | " | " | " | 3.0 | " | " | " | " | " | " |
| 13 | " | " | " | " | " | 1.3 | 0.3 | " | " | " | " | " |
| 14 | " | " | " | " | " | " | 2.5 | " | " | " | " | " |
| 15 | " | " | " | " | " | " | 1.0 | " | 0 | " | " | " |
| 16 | " | " | " | " | " | " | " | " | 0.1 | " | " | " |
| 17 | " | " | " | " | " | " | " | " | 0.005 | 0 | " | " |
| 18 | 0.7 | 1.0 | 0.5 | 1.0 | 0.5 | 1.3 | 1.0 | 0.01 | 0.005 | 0.1 | yes | yes |
| 19 | " | " | " | " | " | " | " | " | " | 0.01 | no | no |
| 20 | " | " | " | " | " | " | " | " | " | " | " | yes |
| 21 | " | " | " | " | " | " | " | " | " | " | yes | " |
| 22 | " | " | " | " | " | " | " | " | " | " | " | " |
| 23 | " | " | " | " | " | " | " | " | " | " | " | " |
| 24 | " | " | " | " | " | " | " | " | " | " | " | " |
| 25 | " | " | " | " | " | 0.001 | " | " | " | " | " | " |
| 26 | " | " | " | " | " | " | " | " | " | " | " | " |
| 27 | " | " | " | " | " | " | " | " | " | " | " | " |
| 28 | " | " | " | " | " | " | " | " | " | " | " | " |
| 29 | " | " | " | " | " | " | " | " | " | " | " | " |

TABLE 1-continued

| | | | | | | | | | | | | |
|---|---|---|---|---|---|---|---|---|---|---|---|---|
| 30 | " | " | " | " | " | 0.1 | " | " | " | " | " | " |
| 31 | " | " | " | " | " | " | " | " | " | " | " | " |
| 32 | " | " | " | " | " | " | " | " | " | " | " | " |
| 33 | " | " | " | " | " | " | " | " | " | " | " | " |
| 34 | " | " | " | " | " | " | " | " | " | " | " | " |

| | Items | | | | | | |
|---|---|---|---|---|---|---|---|
| | Production condition | | Electric properties | | | | |
| Example | Firing (°C.) | Heat treatment (°C.) | $V_{0.1A}$ | $V_{0.1A}/V_{0.1mA}$ | $\Delta V_{0.1A}$ | Surge withstanding (KJ) | Electric life |
| 1 | 1190 | 650 | 283 | 1.36 | 2.5 | 15.9 | ○ |
| 2 | " | 530 | 295 | 1.21 | 2.9 | 16.0 | ◎ |
| 3 | 1170 | 550 | 290 | 1.40 | 1.0 | 16.5 | ◎ |
| 4 | 1165 | 600 | 291 | 1.49 | 0.5 | 16.9 | ◎ |
| 5 | " | 600 | " | 1.45 | 3.0 | 15.4 | ◎ |
| 6 | 1190 | 600 | 260 | 1.49 | 3.0 | 15.5 | ◎ |
| 7 | 1140 | 600 | 310 | 1.50 | 1.0 | 16.1 | ◎ |
| 8 | 1170 | 550 | 290 | 1.39 | 1.0 | 15.9 | ◎ |
| 9 | 1140 | 750 | 330 | 1.43 | 2.8 | 15.1 | ◎ |
| 10 | 1170 | 600 | 303 | 1.45 | 1.0 | 16.0 | ○ |
| 11 | 1130 | " | 350 | 1.46 | 2.4 | 15.0 | ◎ |
| 12 | 1170 | 900 | 290 | 1.20 | 2.3 | 16.9 | ◎ |
| 13 | " | 600 | 292 | 1.49 | 1.0 | 15.9 | ○ |
| 14 | 1150 | 700 | 282 | 1.50 | 2.7 | 15.1 | ◎ |
| 15 | 1160 | 700 | 280 | 1.48 | 0.9 | 17.0 | ◎ |
| 16 | 1190 | 850 | 284 | 1.50 | 1.0 | 16.4 | ◎ |
| 17 | 1200 | 700 | 279 | 1.47 | 2.9 | 15.0 | ○ |
| 18 | 1170 | 750 | 285 | 1.45 | 2.8 | 16.1 | ○ |
| 19 | " | " | 290 | 1.44 | 1.0 | 16.5 | ◎ |
| 20 | 1170 | " | 291 | 1.50 | 2.9 | 15.3 | ◎ |
| 21 | 1170 | 750 | 286 | 1.42 | 2.5 | 16.0 | ◎ |
| 22 | 1160 | 850 | 290 | 1.50 | 3.0 | 16.1 | ◎ |
| 23 | 1210 | " | 250 | 1.46 | 1.0 | 17.3 | ◎ |
| 24 | 1170 | 900 | 292 | 1.20 | 2.8 | 16.5 | ◎ |
| 25 | 1180 | 850 | 290 | 1.50 | 2.7 | 16.2 | ◎ |
| 26 | 1150 | 650 | 291 | 1.41 | 1.8 | 15.0 | ○ |
| 27 | 1160 | " | 289 | 1.42 | 2.7 | 15.4 | ◎ |
| 28 | 1180 | 650 | 286 | 1.39 | 1.0 | 16.8 | ◎ |
| 29 | 1240 | " | 252 | 1.44 | 2.7 | 15.2 | ◎ |
| 30 | 1170 | 700 | 290 | 1.40 | 0.9 | 16.3 | ○ |
| 31 | 1130 | " | 349 | 1.42 | 1.0 | 15.5 | ◎ |
| 32 | 1170 | 900 | 291 | 1.28 | 2.1 | 16.1 | ◎ |
| 33 | 1170 | 700 | 290 | 1.39 | 2.7 | 16.6 | ◎ |
| 34 | 1170 | 650 | 300 | 1.39 | 2.8 | 16.8 | ○ |
| 35 | " | " | 310 | 1.40 | 0.9 | 16.9 | ◎ |
| 36 | " | " | " | 1.41 | 0.5 | 16.5 | ◎ |
| 37 | " | " | 300 | 1.40 | 1.9 | 16.2 | ○ |
| 38 | 1190 | 550 | 293 | 1.35 | 2.2 | 15.9 | ◎ |
| 39 | 1170 | 900 | 293 | 1.20 | 0.9 | 15.1 | ◎ |
| 40 | " | 850 | 294 | 1.22 | 0.8 | 15.3 | ◎ |
| 41 | 1170 | 700 | 296 | 1.25 | 0.4 | 15.6 | ◎ |
| 42 | " | 550 | 295 | 1.24 | 1.9 | 15.0 | ◎ |
| 43 | " | 530 | 299 | 1.21 | 0.8 | 15.8 | ◎ |
| 44 | " | 900 | 290 | 1.25 | 1.0 | 17.0 | ○ |
| 45 | " | 850 | 292 | 1.30 | 0.8 | 16.7 | ◎ |
| 46 | " | 700 | 295 | 1.31 | 2.7 | 15.3 | ○ |
| 47 | " | 550 | 293 | 1.31 | 0.9 | 16.8 | ◎ |
| 48 | " | 530 | 296 | 1.24 | 1.3 | 16.9 | ○ |
| 49 | " | 850 | 288 | 1.40 | 1.0 | 16.9 | ◎ |
| 50 | " | 700 | 290 | 1.39 | 1.0 | 17.3 | ◎ |
| 51 | " | 550 | 294 | 1.39 | 0.9 | 17.0 | ◎ |
| 52 | " | 900 | 290 | 1.31 | 1.5 | 16.6 | ○ |
| 53 | " | 850 | 292 | 1.49 | 1.0 | 17.3 | ◎ |
| 54 | " | 700 | 293 | 1.50 | 1.9 | 15.0 | ○ |
| 55 | " | 550 | 296 | 1.48 | 1.0 | 15.9 | ◎ |
| 56 | " | 530 | 295 | 1.30 | 1.6 | 16.1 | ○ |
| 57 | 1180 | 900 | 294 | 1.41 | 2.3 | 15.9 | ○ |
| 58 | " | 850 | 296 | 1.69 | 1.2 | 16.2 | ○ |
| 59 | " | 700 | 296 | 1.68 | 1.1 | 15.3 | ○ |
| 60 | " | 550 | 297 | 1.70 | 1.3 | 16.1 | ○ |
| 61 | " | 530 | 299 | 1.41 | 2.1 | 16.0 | ○ |

| | Items | | | | | | |
|---|---|---|---|---|---|---|---|
| | Production condition | | Electric properties | | | | |
| Comparative Example | Firing (°C.) | Heat treatment (°C.) | $V_{0.1A}$ | $V_{0.1A}/V_{0.1mA}$ | $\Delta V_{0.1A}$ | Surge withstanding (KJ) | Electric life |
| 1 | 1200 | 550 | 290 | 1.40 | 3 | 12.4 | X |
| 2 | 1160 | " | 283 | " | 8 | 14.1 | ○ |
| 3 | 1170 | " | 287 | 1.37 | 7 | 14.8 | ◎ |

TABLE 1-continued

| | | | | | | | |
|---|---|---|---|---|---|---|---|
| 4 | " | " | 290 | 1.38 | 8 | 14.9 | ◎ |
| 5 | " | 600 | 288 | 1.46 | 1.6 | 15.4 | X |
| 6 | " | " | 293 | 1.49 | 1.9 | 15.9 | X |
| 7 | 1150 | 700 | 281 | 1.50 | 9 | 12.3 | ◎ |
| 8 | 1210 | " | 280 | " | 8 | 11.8 | ○ |
| 9 | 1170 | 750 | 288 | 1.49 | 7 | 15.7 | ○ |
| 10 | " | " | 285 | 1.47 | 7 | 15.6 | ○ |
| 11 | 1160 | 850 | 293 | " | 6 | 15.9 | ◎ |
| 12 | 1180 | " | 291 | 1.48 | 5 | 15.7 | ◎ |
| 13 | 1140 | 650 | 290 | 1.42 | 1.5 | 12.0 | ○ |
| 14 | 1200 | 650 | 286 | 1.43 | 4 | 13.6 | ◎ |
| 15 | 1170 | 700 | 291 | 1.40 | 0.9 | 16.0 | X |
| 16 | " | " | 292 | 1.42 | 4.5 | 16.0 | ◎ |
| 17 | " | " | 305 | 1.39 | 6.2 | 16.3 | ○ |
| 18 | 1170 | 700 | 306 | 1.40 | 3.6 | 15.5 | X |
| 19 | 1190 | 550 | 291 | 1.42 | 6.3 | 14.0 | X |
| 20 | " | " | 293 | 1.43 | 5.2 | 14.5 | ○ |
| 21 | 1245 | " | 230 | 1.42 | 3.2 | 16.3 | ○ |
| 22 | 1115 | " | 380 | 1.49 | 4.2 | 14.0 | X |
| 23 | 1190 | 500 | 295 | 1.13 | 5.1 | 15.0 | ◎ |
| 24 | " | 950 | 294 | 1.15 | 4.5 | 15.1 | X |
| 25 | 1170 | 900 | 293 | 1.14 | 0.3 | 13.2 | ◎ |
| 26 | " | 850 | 290 | 1.16 | 0.3 | 13.8 | ◎ |
| 27 | " | 700 | 292 | 1.15 | 0.4 | 13.7 | ◎ |
| 28 | " | 550 | 293 | 1.16 | 0.5 | 13.3 | ◎ |
| 29 | " | 530 | 290 | 1.13 | 0.4 | 13.2 | ◎ |
| 30 | 1185 | 900 | 296 | 1.71 | 8.8 | 14.3 | X |
| 31 | " | 850 | 295 | 2.45 | 4.5 | 14.9 | X |
| 32 | " | 700 | 294 | 2.41 | 6.0 | 14.1 | X |
| 33 | " | 550 | 298 | 2.46 | 7.3 | 14.0 | X |
| 34 | " | 530 | 300 | 1.83 | 9.0 | 13.9 | X |

Figure 2:
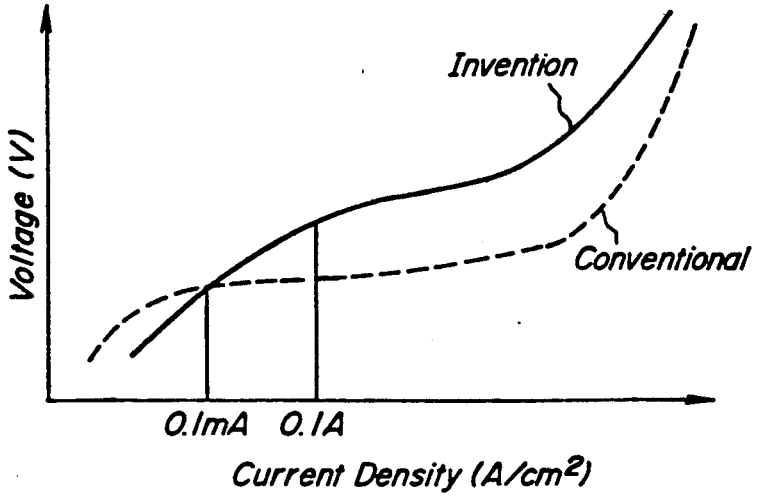
FIG. 2 is a characteristic graph of voltage-current characteristic properties of a conventional voltage non-linear resistor and an example of the voltage non-linear resistor of the present invention.

In the present invention, superior voltage-current characteristic properties as shown in FIG. 2, for example, can be obtained by using the aforementioned compositions, calcining zinc oxide and aluminum, forming the green body of the voltage non-linear resistor, firing the green body at the aforementioned temperature, and heat treating the fired body at the high temperature.

Moreover, the deterioration rate of the limited voltage ($V_{0.1\,A}$) after applying a lightning surge is small, so that $V_{0.1\,A}$ designing of the resistor for use in lightning arrestors becomes possible. Furthermore, the limited voltage ($V_{0.1\,A}$) is also high, so that shortening of the length of the limited current element portion of the lightning arrestor can be realized. The preferable use of an atlighter in the mixing of zinc oxide in which aluminum is solid soluted and the other metal oxides, can further decrease the deterioration rate of the above-described limited voltage ($V_{0.1\,A}$), and further shorten the length of the limited current element portion.

Furthermore, by making the limited voltage ratio $V_{0.1\,A}/V_{0.1\,mA}$ to a value of the above range, the gap discharge current characteristic property is improved and the insulation cooperative property with the arc horn is improved.

Furthermore, all the cut-off property of follow current, the lightning surge discharge current withstanding capability, the switching surge discharge current withstanding capability, the limited voltage at large current area, and the electric life are superior, so that the resistor of the present invention is quite superior as a voltage non-linear resistor for use in gapped lightning arrestors.

Although the present invention has been explained with specific examples and numerical values, it is of course apparent to those skilled in the art that various changes and modifications thereof are possible without departing from the broad spirit and aspect of the present invention as defined in the appended claims.

What is claimed is:

1. A voltage non-linear resistor for use in a gapped lightning arrestor having a composition containing (1) 0.5–1.2 mole % of bismuth oxide calculated as $Bi_2O_3$, (2) 0.3–1.5 mole % of cobalt oxide calculated as $Co_2O_3$, (3) 0.2–0.8 mole % of manganese oxide calculated as $MnO_2$, (4) 0.5–1.5 mole % of antimony oxide calculated as $Sb_2O_3$, (5) 0.1–1.5 mole % of chromium oxide calculated as $Cr_2O_3$, (6) 0.6–2.0 mole % of silicon oxide calculated as $SiO_2$, (7) 0.8–2.5 mole % of nickel oxide calculated as NiO, (8) 0.004–0.04 mole % of aluminum oxide calculated as $Al_2O_3$, (9) 0.0001–0.05 mole % of boron oxide calculated as $B_2O_3$, (10) 0.001–0.05 mole % of silver oxide calculated as $Ag_2O$, and (11) the rest of zinc oxide, (12) a limited current of 250–350 V/mm at a current density of 0.1 A/cm² calculated per unit thickness of the sintered resistor, (13) a limited current ratio $V_{0.1A}/V_{0.1mA}$ of 1.2–1.7 at current densities of 0.1 A/cm² and 0.1 mA/cm², and (14) a deterioration rate of limited current of not more than 3% at a current density of 0.1 A/cm² before and after applying twice a lightning surge current (4/10 μs wave form) of 5 KA/cm² per unit surface area.

2. A method of producing a voltage non-linear resistor for use in a gapped lightning arrestor, comprising i) forming a green body of the voltage non-linear resistor having a composition containing (1) 0.5-1.2 mole % of bismuth oxide calculated as $Bi_2O_3$, (2) 0.3–1.5 mole % of cobalt oxide calculated as $Co_2O_3$, (3) 0.2–0.8 mole % of manganese oxide calculated as $MnO_2$, (4) 0.5–1.5 mole % of antimony oxide calculated as $Sb_2O_3$, (5) 0.1–1.5 mole % of chromium oxide calculated as $Cr_2O_3$, (6) 0.6–2.0 mole % of silicon oxide calculated as $SiO_2$, (7) 0.8–2.5 mole % of nickel oxide calculated as NiO, (8) 0.004–0.04 mole % of aluminum oxide calculated as $Al_2O_3$, (9) 0.0001–0.05 mole % of boron oxide calculated as $B_2O_3$, (10) 0.001–0.05 mole % of silver oxide calculated as $Ag_2O$, and (11) the rest of zinc oxide, ii) the green body being formed by mixing zinc oxide of (11) and a solution containing aluminum of an amount corresponding to aluminum oxide of (8), spray drying the mixture, calcining the spray dried mixture, granulating the calcined mixture and the other said metal oxides added thereto, and shaping, iii) firing at 1,130°–1,240° C., and iv) heat treating at 30°–900° C.

* * * * *